US005138373A

United States Patent [19]

Hoyer

[11] Patent Number: 5,138,373

[45] Date of Patent: Aug. 11, 1992

[54] COPIER OR PRINTER COMPONENT POSITION FLOATING MAGNETIC ACTUATOR

[75] Inventor: August Hoyer, Penfield, N.Y.

[73] Assignee: Xerox Corporation, Stamford, Conn.

[21] Appl. No.: 807,357

[22] Filed: Dec. 16, 1991

[51] Int. Cl.[5] ..... G03G 15/00

[52] U.S. Cl. ..... 355/200; 271/162; 335/205; 355/205; 355/208

[58] Field of Search ..... 355/200, 202, 203, 205, 355/209, 308, 309; 335/205-207; 271/162-164; 221/4, 197, 287; 340/547, 568; 200/61.58 R

[56] References Cited

U.S. PATENT DOCUMENTS

| | | | |
|---|---|---|---|
| 3,888,582 | 6/1975 | Griswold | 355/309 X |
| 3,890,476 | 6/1975 | Canter et al. | 335/205 X |
| 4,241,337 | 12/1980 | Prada | 335/206 X |
| 4,402,498 | 9/1983 | Suzuki | 271/164 |
| 4,585,333 | 4/1986 | Yamagishi | 355/202 |

*Primary Examiner*—A. T. Grimley
*Assistant Examiner*—William J. Royer

[57] ABSTRACT

In a copier or printer a magnetic switch system is often used to indicate or signal the separation, mating, alignment or docking of components movable relative to one another, by the actuation or non-actuation of a magnetic switch on a first such component, such as a fixed frame member, by a magnet or a second such component, such as a manually movable tray, which magnet and magnetic switch are positioned such that as the components are moved together and docked the magnet actuates the magnetic switch. Here, the magnet is resiliently cantilever mounted to the second component to extend out towards the first component in the movement direction by a substantial preset distance (when undocked) sufficient to accommodate and compenaste for a substantial variation in the first and second components docking positions by actuation of the magnetic switch by the magnet anywhere within the range of the preset distance by flexing of the spring with further movement of the components towards one another after the magnet initially actuates the magnetic switch. The spring has a sufficiently low resiliency to not interfere with the normal relative movement of the components. The spring is also sufficiently elongated in the direction transverse the movement direction to maintain actuation of the magnetic switch by the magnet within the range of the preset distance irrespective of the flexing of the spring.

2 Claims, 1 Drawing Sheet

COPIER OR PRINTER COMPONENT POSITION FLOATING MAGNETIC ACTUATOR

Figure 1:
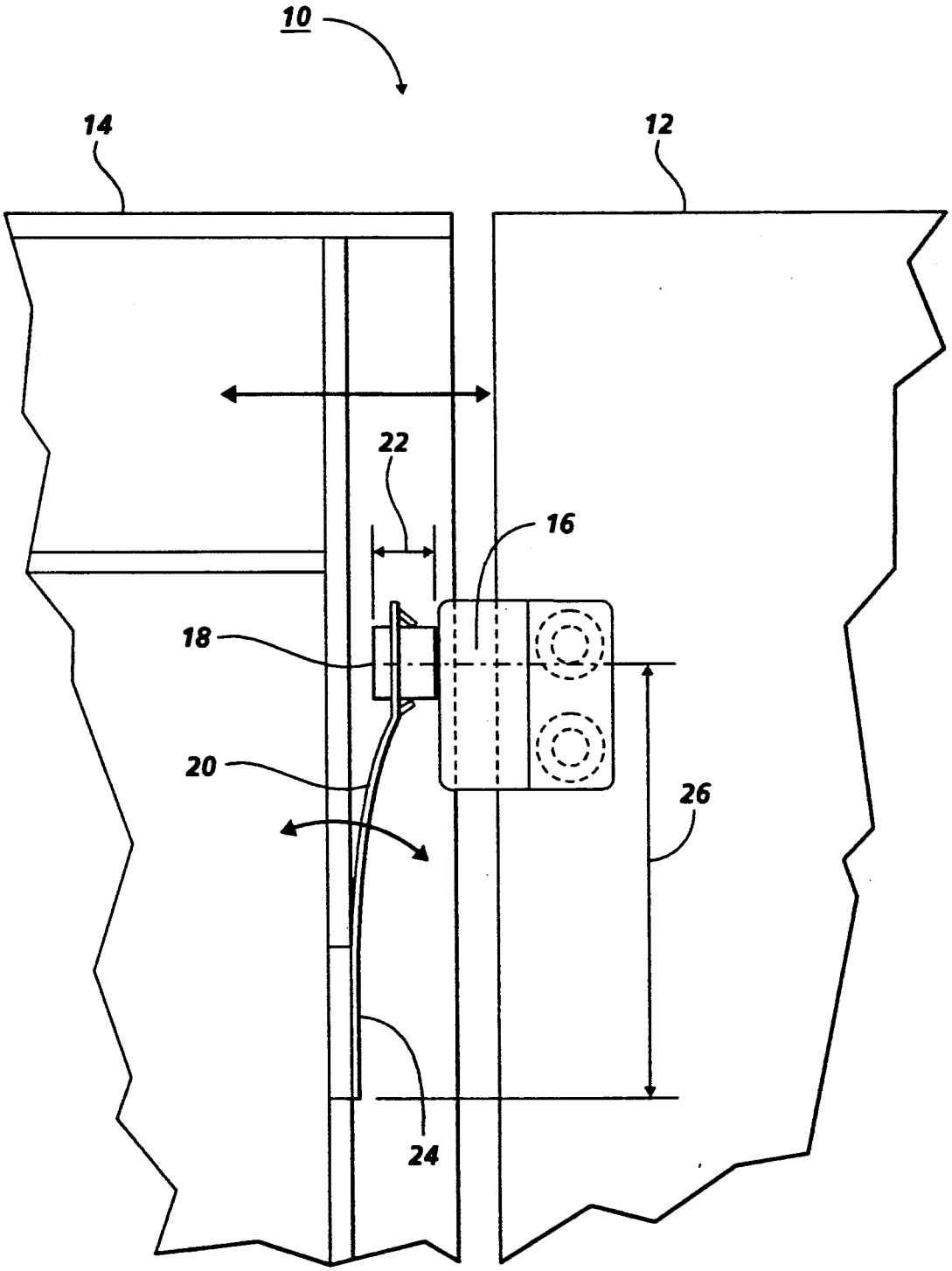

There is disclosed herein an improvement in reproducing machines, and, more particularly, an improved system for electrically sensing, signaling or detecting copier or printer component positions, or module docking, or the like, with an improved magnetically actuated switch system.

In particular, there is disclosed an improved, low cost, more reliable, magnetically actuated switch system to more reliably and repeatably indicate a component movement or alignment or docking relative to another component or to the frame of the apparatus, which is more tolerant of manufacturing and/or alignment tolerances or errors and/or excessive play, runout, "slop", flexing, over-pivoting or random movement in one or both components, and which is less likely to give erroneous a tuitions or miss-actuations, and/or premature de-actuations, and/or switch chatter and/or signal noise, as a result thereof. Such switch actuation errors can lead to unnecessary machine shutdowns, jams, and/or adjustments or repairs.

Magnet actuated reed switches, for example, can function well to indicate such component positions or dockings when the actuating position or distance movement is highly repeatable. However, the switch actuation is subject to errors when either the permanent magnet on one component, or the magnetic switch on the other component, are mounted on components with a wide range of tolerances or variations in movement or alignment [especially, without an adjustment or realignment feature, but that undesirably adds labor or repair costs ].

The control of operating systems in copiers, printers and the like is conventionally accomplished by signals from the machine controller, directly or indirectly, in response to programmed commands and from selected actuation or non-actuation of various machine switch or sensor inputs. Known copying systems utilize conventional microprocessor controls with circuitry connecting with various such switches and sensors for controlling the operation of the machine, including document and copy sheet feeders and inserters, gates, etc. Important switch inputs incur the positions of various components, which tell the controller that those components, such as trays, connecting finisher modules, gates, inserted processor modules, etc., are in their proper positions to perform functions selected by the operator and/or otherwise required to be enabled or to be in certain positions for the reproduction machine to operate properly and/or avoid jams.

Further by way of background, in modern manufacturing it has become common to have components manufactured at various locations, even in different countries, and to different standards, or from different sources, and yet final assembly may be in yet another country or even by the ultimate customers, after much shipping and handling. Also, it is desirable not to require higher or closer tolerances for components or their movement than are actually required, so as to reduce manufacturing and assembly costs.

A specific feature of the specific embodiment(s) disclosed herein is to provide in copier or printer apparatus, in which a magnetic switch system indicates or signals the separation, acting, alignment or docking of components movable relative to one another, by the actuation or non-actuation of a magnetic switch on a first such component by a magnet on a second such component, which magnet and magnetic switch are positioned such that as said first and second components are moved together or docked in their normal relative movement direction said magnet actuates said magnetic switch; the improvement in said magnetic switch system wherein: said magnet is resiliently cantilever mounted to said second component extended out on as elongate spring; said spring extending said magnet out from said second component towards said first component in the direction of their movement towards one another by a substantival preset distance in their undocked position sufficient to accommodate and compensate for a substantial variation in said first and second components docking positions by actuation of said magnetic switch by said magnet anywhere within the range of said preset distance by flexing of said spring with further movement of said fist and second components towards one another after said magnet initially actuates said magnetic switch; said spring having a sufficiently slow resiliency to not interfere with said normal relative movement of said first and second components; and said spring being sufficiently elongated in the direction transverse said movement direction to maintain actuation of said magnet switch by said magnet within said range of said preset distance irrespective of said flexing of said spring.

Further specific features provided by the system disclosed herein, individually or in combination, include those wherein said second component is a manually movable tray and said first component is a fixed frame member of said copier or printer.

As to specific hardware components of the subject apparatus, it will be appreciated that, as is normally the case, that some such specific hardware components are known per se in other apparatus or applications. For example, various magnetic switches per se are well known and commercially available, as shown in Xerox Corporation U.S. SIR H43 published Apr. 1, 1986 and art cited therein including U.S. Pat. NO. 3,418,610 and 3,533,029, and need not be described herein.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well s the claims. Thus the present invention will be better understood from this description of an embodiment thereof, including the drawing figure (approximately to scale) wherein:

The FIGURE is a top view of one embodiment of the present system, partially showing two schematic copier or printer components movable relative to one another, with an exemplary magnetic switch system tin accordance with the present invention to indicate to the copier or printer their docking or alignment, or their separation, by actuation or non-actuation of a magnetic switch on one component by a magnet on the other.

Describing now in further detail the exemplary embodiment with reference to the Figure, there is shown a portion of a reproducing machine 10 with two relatively movable components 12 and 14, merely by way of one example of an application of the present invention. Merely by way of example, these may be a machine frame 12 and a sliding tray 14. Here, there is a commercial magnet reed switch 16 on component 12 and a small permanent magnet 18 on the other component 13, in a mutual movement path so that as the two components 12, 14, are brought together or docked, the magnet 18 closes or actuates the magnet reed switch 16 in a conventional manner to so signal and thus so indicate.

Merely as one example of a suitable location or use of such a system is with a dual position or dual mode output stacking tray usable for stacking either cut sheet or fan-folding computer form web documents, as shown in allowed U.S. application Ser. No. 07/645,862, filed Jan. 25, 1991 by the same August Hoyer together with John R. Masley and Thomas E. Bitter, U.S. Pat. No. 5,081,487 entitled "Cut Sheet and Computer Form document Output Tray Unit". The magnetic switch 16 can communicate to the copier or printer 10 controller software whether the tray 14 is in the proper position for the selected copying mode before copying is allowed to begin, and/or provide an instructive display to the operator telling the operator to move the tray 14 to the proper position.

However, differing from a normal, magnetic switch indicating or actuating system, here, the magnet 18 used to actuate the switch 16 is not fixed or rigidly mounted to the component 14. Rather, the magnet 18 here is resiliently cantilever mounted to the end of a relatively flat, but arcuate, low rate (soft) spring 20. This mounting of the magnet 18 can take up or accommodate a large tolerance between the two complimentary components 12, 14. The spring 20 can compensate for a large gap or variation in component docking positions. The spring 20 extends the magnet 18 out from the moving component 14 by a substantial preset distance 22 [e.g., roughly 6 mm] towards the fixed component 12, so that the magnet 18 can closely engage or abut and positively actuate the switch 16 at an component 14 position at or less than said distance 22. if the component 14 can or does move closer to component 12, then the spring 20 simply flexes to accommodate and compensate for that movement or position variation, without the magnet 18 ever disengaging from the switch 16, irrespective of the relative component positions, as long as it is closer than or within the distance 22. Here, that is engaged by the mounting end of spring 20 being mounted at its end 24 by a substantial distance 26 laterally (transversely) of the primary movement direction between the magnet 18 and switch 16 (the movement direction of the component 14) [e.g., roughly 30 mm], so that the magnet 18 flexes red rotates about a relatively large radius, so that the magnet 18 does not move laterally (transversely) of the switch 16 by a substantial amount as the spring 20 flexes. The mounting end 24 of spring 20 may be mounted to movable component 14 by a slide-on clip mounting or the like so as to be readily replaceable, if desired.

It will be appreciated that it is preferable to mount the magnet in this manner, rather than the switch, and to mount the magnet to the moving component, since otherwise flexible wiring to the switch would be required, However, that could be done in some circumstances, if desired.

Also note that preferably, as shown, the stop, or movement limit, or abutment between the two components 12, 14 is not by the engagement of the magnet 18 with the switch 16. The spring 20 can continue to flex and protect both the magnet 18 and the switch 16 from any impact damage even if the component 14 is overdriven against the component 12 beyond the normal abutment or stopping position therebetween.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a copier or printer apparatus, in which a magnetic switch system indicates or signals the separation, mating, alignment or docking of components movable relative to one another, by the actuation or non-actuation of a magnetic switch on a first such component by a magnet on a second such component, which magnet and magnetic switch are position such that as said first and second components are moved together or docked in their normal relative movement direction said magnet actuates said magnetic switch; at the improvement in said magnetic switch system wherein:

said magnet is resiliently cantilever mounted to said second component extended out on a elongate spring, said spring extending said magnet out from said second component towards said first component in the direction of tier movement towards one another by a substantial preset distance in their undocked position sufficient to accommodate and compensate for a substantial variation in said first and second components docking positions by actuation of said magnetic switch by said magnet anywhere within the range of said preset distance by flexing of said spring with further movement of said first and second components towards one another after said magnet initially actuates said magnetic switch, said spring having a sufficiently low resiliency to not interfere with said normal relative movement of said fist and second components, and said spring being sufficiently elongated int eh direction transverse said movement direction to maintain actuation of said magnetic switch by said magnet within said range of said present distance irrespective of said flexing of said spring.

2. The copier or printer apparatus of claim 1, wherein said second component is a manually movable tray and said first component is a fixed frame member of said copier or printer.

* * * * *